US005615615A

United States Patent [19]

Theurer et al.

[11] Patent Number: 5,615,615

[45] Date of Patent: Apr. 1, 1997

[54] TRACK WORKING MACHINE

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 527,076

[22] Filed: Sep. 12, 1995

[30] Foreign Application Priority Data

Sep. 15, 1994 [AT] Austria ..... 1765/94

[51] Int. Cl.[6] ..... E01B 33/00

[52] U.S. Cl. ..... 104/2; 105/157.1; 105/199.1

[58] Field of Search ..... 104/2, 3, 4, 5, 104/7.1, 12, 15; 105/72.2, 215.1, 215.2, 157.1, 172, 199.1, 211

[56] References Cited

U.S. PATENT DOCUMENTS

| | | | |
|---|---|---|---|
| 3,503,339 | 3/1970 | Kershaw | 105/72.2 |
| 4,178,995 | 12/1979 | Theurer et al. | 104/2 |
| 4,207,820 | 6/1980 | Cicin-Sain | 104/2 |
| 4,657,099 | 4/1987 | Baltensperger | 104/2 |
| 5,103,740 | 4/1992 | Masse | 105/72.2 |
| 5,257,579 | 11/1993 | Theurer | 104/2 |
| 5,469,791 | 11/1995 | Theuere et al. | 104/2 |
| 5,502,904 | 4/1996 | Theurer et al. | 104/2 |

FOREIGN PATENT DOCUMENTS

| | | | |
|---|---|---|---|
| 741961 | 9/1966 | Canada | 104/2 |
| 61227 | 9/1982 | European Pat. Off. | 104/5 |
| 433935 | 6/1991 | European Pat. Off. | 104/2 |

*Primary Examiner*—Mark T. Le
*Attorney, Agent, or Firm*—Henry M. Feiereisen

[57] ABSTRACT

A track working machine includes a machine frame and a body structure mounted on the machine frame and incorporating a motor. A lower horizontal underside of the machine frame is equipped with fasteners for detachably securing undercarriages as well as a coupling for permitting a detachable connection of a power supply line with further power supply lines of a drive and a brake unit of a undercarriage.

10 Claims, 2 Drawing Sheets

TRACK WORKING MACHINE

BACKGROUND OF THE INVENTION

The present invention refers to a track working machine of a type including a machine frame and a body structure mounted on the machine frame and equipped with a motor.

Track working machines of this type are known in various configurations and for use at different job sites. Normally, the track working machine is positioned in close proximity to the job site so as to be fairly easily transferable for use either in train formation or through a self-propelling mechanism. Construction sites outside a country or even on a different continent require very complicated and cumbersome retrofitting works and special transport units to enable e.g. a shipping of the track working machine.

SUMMARY OF THE INVENTION

It is an object of the present invention to provide an improved track working machine, obviating the above stated drawbacks.

It is another object of the present invention to provide an improved track working machine that can be transported to remote job sites at minimal retrofitting works and in a particular simple manner.

These objects and others which will become apparent hereinafter are attained in accordance with the present invention by providing a first set of fastener assemblies for permitting a detachable securement of undercarriages to a lower, horizontal underside or boundary surface of the machine frame, and by providing a coupling assembly for permitting connection of a power supply line to further power supply lines of a drive and a brake unit of an undercarriage.

By limiting its downward extension in vertical direction to the level of the undercarriages, the machine frame together with the body structure can easily be shipped in a similar fashion as a container, whereby the machine frame forms simultaneously a platform for easy storage of the machine unit from which the undercarriages are removed. The required modifying steps are essentially limited to the detachment of the undercarriages from the machine frame and thus can be executed in a rapid and simple manner. In the event, a more frequent transfer of the machine unit to remote construction sites is desired, it may be suitable to prepare two sets of undercarriages for each construction site to eliminate the transfer of undercarriages and thus to further facilitate the transport.

A further advantage of the present invention is the capability of storing the machine unit without the undercarriages on a track-bound or road-bound transport vehicle. Also the presence of different track gages does not pose any problems when using two different sets of undercarriages.

According to another feature of the present invention, the track working machine may include a second set of fastener assemblies in vicinity of the axial ends of the machine frame for detachable securement of vertically adjustable lifting jacks, and a hydraulic coupling arrangement for detachable connection of respective hydraulic lines of the lifting jacks with the hydraulic pump. A third fastener assembly may be provided for detachably securing in the gravitational center area of the machine frame a turntable which has a support jack that is rotatable and vertically adjustable about a vertical axis, with the respective power supply line for enabling a vertical adjustment of the turntable being connectable to a coupling.

Preferably the body structure has four side walls for defining a cab and a ceiling that extends parallel to the boundary surfaces of the machine frame whereby a vertically and laterally adjustable jib may be positioned between the cab and one axial end of the machine frame. Suitably, various working aggregates, such as a flash butt welding unit, may be operated by the jib for suitable positioning relative to the track.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
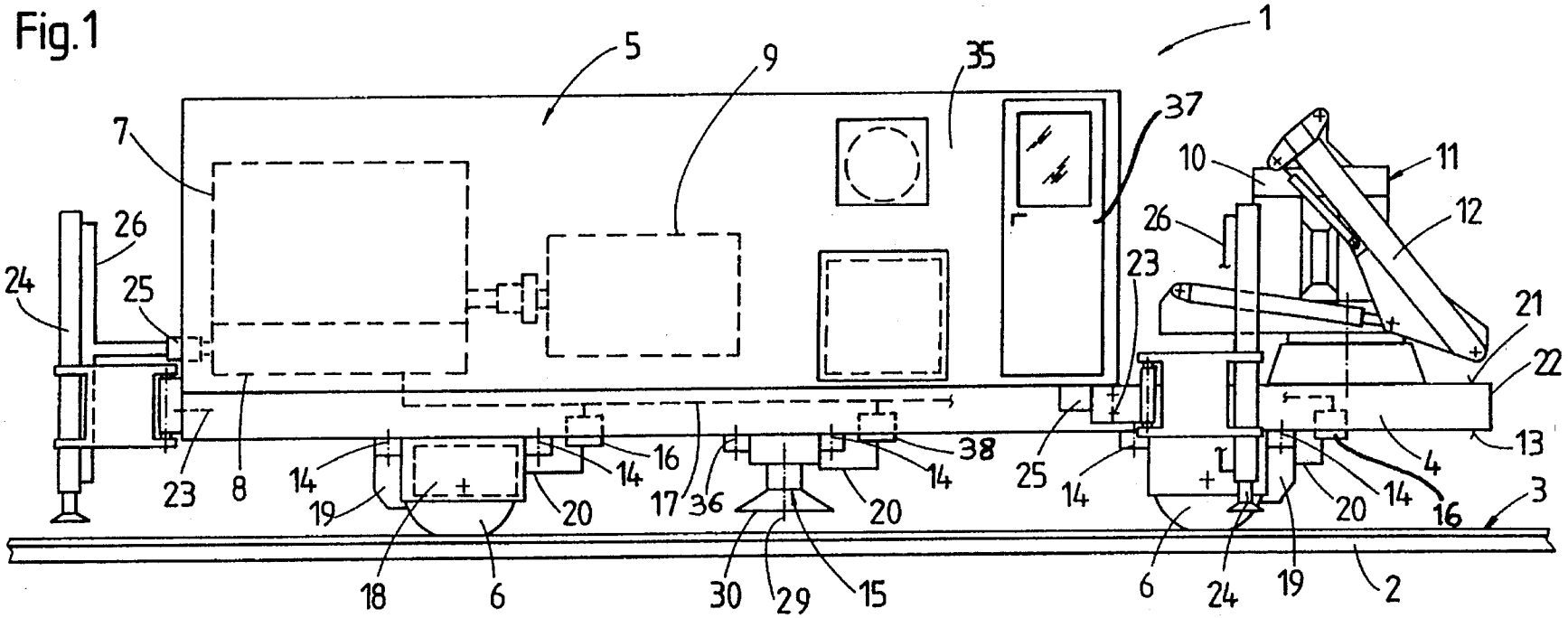
FIG. 1 is a side elevational view of one embodiment of a track working machine according to the present invention.

Throughout all the Figures, the same or corresponding elements are generally indicated by the same reference numerals.

Turning now to the drawing, and in particular to FIG. 1, there is shown a side elevational view of one embodiment of a track working machine according to the present invention, generally designated by reference numeral 1, used e.g. for welding rails 2 of a track 3. The track working machine 1 includes a machine frame 4 which is supported by undercarriages 6 for movement along the track 3 in an operating direction. The machine frame 4 is defined by a deck 21 to define an upper boundary surface and an underside 13 to define a lower boundary surface that parallels the deck 21. Mounted to the deck 21 is a body structure which is generally designated by reference numeral 5 and is equipped with a motor 7, a hydraulic pump 8 and a generator 9. The elements 7, 8, 9 are indicated schematically in broken lines only, for ease of illustration.

Further placed on the deck 21 of the machine frame 4 is a jib 12 which is rotatable and vertically adjustable through operation of respective drive mechanisms and supports a working aggregate, generally designated by reference numeral 11 and including a flash butt welding unit 10. Thus, the flash butt welding unit 10 can be shifted by the jib 12 for suitable positioning relative to the track 3 to effect a welding operation.

The underside 13 which extends horizontal and parallel to the plane defined by the wheel contact areas of the undercarriages 6 is provided with fasteners 14, such as screw fasteners, for permitting detachable securement of the undercarriages 6 to the underside 13, and with like fasteners 36 for permitting detachably securement of a vertically adjustable turntable 15 in the area of the gravity center of the track working machine 1 between the undercarriages 6. The turntable 15 includes a vertically adjustable support jack 30 which is rotatable about a vertical axis 29.

The machine frame 4 is further provided with couplings 16 spaced in operating direction for connection of a power supply line 17 from the hydraulic pump 8 with further power supply lines 20 linked to a drive 18 of one undercarriage 6 for advancing the machine frame 4 along the track 3, and a brake unit 19 which acts upon the undercarriages 6. A further coupling 38 allows connection of the power supply line 17 with the power supply line 20 to the turntable 15 for allowing a rotation of the machine frame 4.

As stated above, the machine frame 4 extends in a plane and is defined by the underside 13 and the parallel upper deck 21 which also forms a platform for attachment of the body structure 5. The body structure 5 includes four side walls 27 for defining a cab 35 which encloses the motor 7, the hydraulic pump 8 and the generator 9. On one end, the cab 35 has a door 37 for access to the interior. The top of the cab 35 is closed by a ceiling 28 which extends parallel to the deck 21 and the underside 13 of the machine frame 4.

Figure 2:
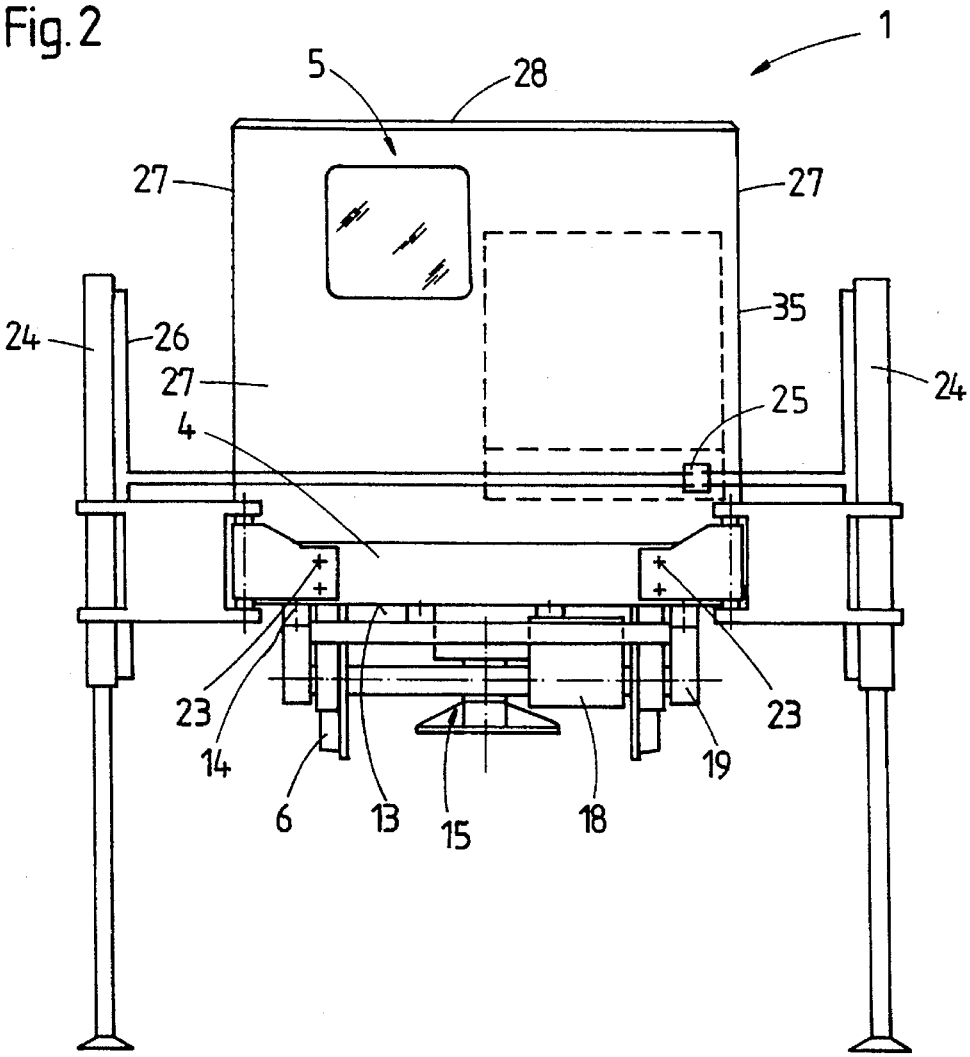
FIG. 2 is a plan view in longitudinal direction of the track working machine, illustrating lifting jacks in an extended position.

As shown in particular in FIG. 2, the machine frame 4 has one axial end (left hand side in FIG. 1) that extends perpendicular to the longitudinal axis of the machine frame 4 and is provided with fasteners 23 for detachably securement of vertically adjustable lifting jacks 24. The side wall 27 at this axial end 22 is equipped with a hydraulic coupling 25 for detachably securing hydraulic lines 26 of the hydraulic jacks 24 to the hydraulic pump 8 to thereby allow operation of the lifting jacks 24. The machine frame 4 is provided with further fasteners 23 at the side wall 27 near the door 37 in vicinity of the opposite axial end 22 for detachably connecting further lifting jacks 24. A further hydraulic coupling 25 is provided for detachably connection of hydraulic lines 26 of the further lifting jack 24 with the hydraulic pump 8.

The fasteners 14, 23, 36 may be of any suitable conventional type, such as e.g. screw fasteners, in order to effect a detachable securement of the undercarriages 6, the lifting jacks 24 and the turntable 15 to the track working machine 1. Therefore, these fasteners are shown only schematically in the drawing for ease of illustration. Also, the couplings 16, 25, 38 are shown only schematically and may be of any suitable conventional type to effect a detachable securement of the power lines 26.

As best seen in FIGS. 1 and 2, the body structure 5 extends in plan view of the machine 1, i.e. in a view perpendicular to the boundary surfaces 13, 21, within the outline or perimeter of the machine frame 4. Also the jib 12 together with the working aggregate 11 extends within the outline of the machine frame 4 when preparing the track working machine 1 for transfer or shipment.

At operation, the track working machine 1 is advanced by the drive 18 along the track 3 from welding site to welding site for performing the desired welding operations by means of the flash butt welding unit 10 which is lowered by the jib 12 onto the track 3 beyond the respective axial end 22 of the machine frame 4. If desired, the entire track working machine 1 can be turned by 180° about the vertical axis 29 by the vertically adjustable support jack 30 of the turntable 15 to change the operational position of the machine 1. Moreover, through lowering of the lifting jacks 24, the track working machine 1 can be lifted off the track 3 for self-loading purposes.

In order to enable a transport of the track working machine 1 in a simple manner in form of a container to remote job sites, the fasteners 14, 36 as well as the couplings 16 are loosened and released to remove both undercarriages 6 as well as the turntable 15 from the machine frame 4. Suitably, during this work, the lifting jacks 24 are lowered onto the track 3 to raise the track working machine 1, thereby facilitating the detachment of the undercarriages 6 and the turntable 15. Subsequently, a transport vehicle is moved underneath the elevated track working machine 1 which then is lowered onto the transport vehicle through retraction of the lifting jacks 24. Subsequently, the lifting jacks 24 can be disengaged through loosening the fasteners 23 and pulling off the hydraulic lines 26 from the hydraulic coupling 25 of the track working machine 1.

Figure 3:
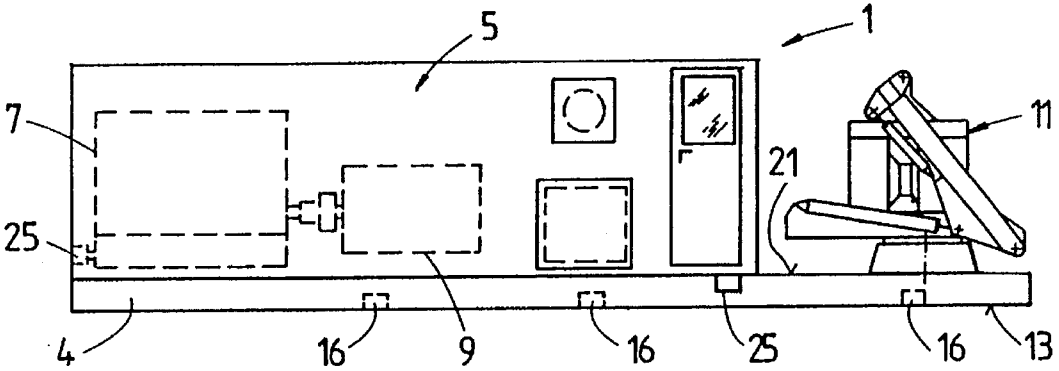
FIG. 3 is a side elevational view of the track working machine, illustrating the track working machine in a position ready for shipment.

FIG. 3 shows the configuration of the track working machine 1 in shipping position. In this position, the track working machine 1 can be loaded as a container onto a ship and transported to remote job sites. It is however also possible to mount the track working machine 1 without the undercarriages 6 onto a track-bound transport vehicle for welding rails. Also, instead of using undercarriages 6 for track-bound operation, road-bound undercarriages that are attached to the underside 13 of the machine frame 4 can be used to permit operation on roadways.

Figure 4:
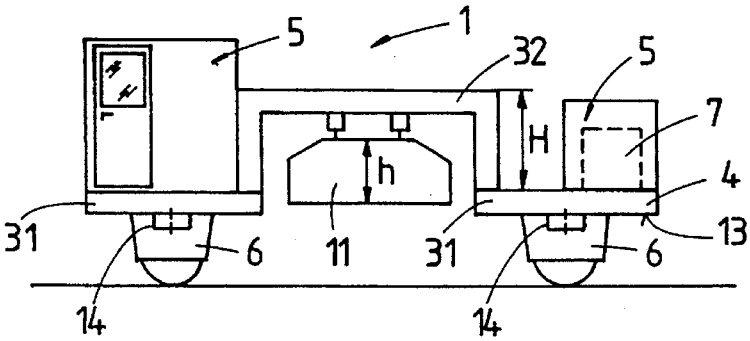
FIG. 4 is a schematic side view of another embodiment of a track working machine, with a modified frame construction.

Turning now to FIG. 4, there is shown another embodiment of a track working machine 1, with the difference residing in the configuration of the machine frame 4 which now includes two carrier frames 31 that are spaced from each other in operating direction. Each carrier frame 31 supports a body structure 5, with the body structure 5 of the left-hand carrier frame 31 e.g. representing the operator's cab and the body structure 5 on the right-hand carrier frame 31 incorporating the motor 7.

The carrier frames 31 together define the lower boundary surface or underside 13 in a plane to enable again a container-like loading of the track working machine 1 after removal of the undercarriages 6 that are detachably secured to the underside 13. Both carrier frames 31 are joined together by a frame structure 32 of inverted U-shape or upwardly cranked configuration. Mounted to the underside of the cranked frame structure 32 is for example a vertically adjustable working aggregate 11 in form of a track grinder that has a height h which is smaller than the vertical height H of the cranked frame structure 32. Thus, the body structures 5 together with the working aggregate 11 extend within the outline or perimeter of the machine frame 4 to enable a container-like loading of the track working machine 1.

Figure 5:
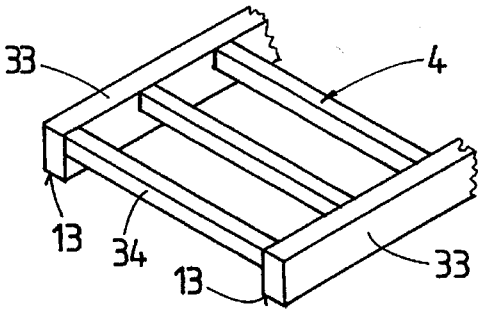
FIG. 5 is a simplified, perspective illustration of a modified machine frame.

FIG. 5 shows a modified structure of the machine frame 4 which is provided in form of two longitudinal beams 33 extending parallel to each other longitudinally in operating direction of the track working machine and joined together by parallel crossbars 34, with the lower boundary surface 13 being formed by the underside of the longitudinal beams 33.

While the invention has been illustrated and described as embodied in a track working machine, it is not intended to be limited to the details shown since various modifications and structural changes may be made without departing in any way from the spirit of the present invention.

What is claimed as new and desired to be protected by Letters Patent is set forth in the appended claims:

1. A track working machine; comprising:

a machine frame configured to be selectively supported directly on a generally flat surface or supported by undercarriages for movement along a track in operating direction, said machine frame having opposing axial ends in a longitudinal direction and exhibiting an underside forming a leveled surface between the axial ends when removing said undercarriages for allowing stable placement of said machine frame on said flat surface;

a body structure placed upon said machine frame and incorporating a motor;

a first set of fastener assemblies provided at said underside for permitting a detachable securement of said undercarriages to said underside of said machine frame, and configurated to allow placement of the machine frame directly on said generally flat surface when the undercarriages are removed; and a first set of coupling arrangements received in said underside for permitting a connection of a power supply line to power supply lines of a drive and a brake unit of an undercarriage.

2. The machine of claim 1 wherein said machine frame is defined by an upper deck extending parallel to said underside.

3. The machine of claim 1 wherein said machine frame has opposing axial ends extending perpendicular to the longitudinal axis, and further comprising a second set of fastener assemblies in vicinity of said axial ends for permitting detachable securement of vertically adjustable lifting jacks; and a second set of hydraulic coupling arrangements for detachable connection of hydraulic lines that communicate with the lifting jacks.

4. The machine of claim 1, further comprising a third fastener assembly positioned at the underside in a gravitational center area of said machine frame, a turntable detachably secured to the third fastener assembly and having a support jack which is rotatable and vertically adjustable about a vertical axis; and a third coupling arrangement for attachment of a power supply line for effecting a vertical adjustment of the turntable.

5. The machine of claim 2 wherein said body structure has four side walls for defining a cab and a ceiling extending parallel to said deck and said underside of said machine frame, and further comprising a vertically and laterally adjustable jib that is positioned between said cab and one axial end face of said machine frame and is mounted on said deck; and a working aggregate connected to said jib.

6. The machine of claim 5 wherein the working aggregate is a flash butt welding unit.

7. The machine of claim 5 wherein said machine frame is of plateau-shaped configuration having ends defining an outline, said cab being positioned within the outline of said machine frame.

8. The machine of claim 7 wherein said working aggregate and further working aggregates are positioned outside said cab and arranged within the outline of said machine frame.

9. The machine of claim 1 wherein said machine frame is formed by two carrier frames extending in a common plane and spaced from each other longitudinally in operating direction, and a crank-shaped frame structure for joining together said carrier frames.

10. The machine of claim 9, further comprising a vertically adjustable working aggregate mounted to said frame structure and having a height which is smaller than a vertical extension of said frame structure.

* * * * *